US007175044B2

(12) United States Patent
Benktzon et al.

(10) Patent No.: US 7,175,044 B2
(45) Date of Patent: Feb. 13, 2007

(54) BLISTER PACK DEVICE

(75) Inventors: Maria Benktzon, Bromma (SE); Thomas Nilsson, Bromma (SE); Malin Oreback, Bromma (SE); Stefan Strandberg, Bromma (SE)

(73) Assignee: AstraZeneca AB, Sodertalje (SE)

( * ) Notice: Subject to any disclaimer, the term of this patent is extended or adjusted under 35 U.S.C. 154(b) by 235 days.

(21) Appl. No.: 10/505,521

(22) PCT Filed: Feb. 24, 2003

(86) PCT No.: PCT/SE03/00308

§ 371 (c)(1),
(2), (4) Date: Aug. 23, 2004

(87) PCT Pub. No.: WO03/070598

PCT Pub. Date: Aug. 28, 2003

(65) Prior Publication Data

US 2005/0139605 A1 Jun. 30, 2005

(30) Foreign Application Priority Data

Feb. 25, 2002 (SE) ..... 0200561

(51) Int. Cl.
*G07F 11/66* (2006.01)

(52) U.S. Cl. ..... 221/25; 206/531; 206/532

(58) Field of Classification Search ..... 221/25; 206/531, 532, 539, 533, 534.1
See application file for complete search history.

(56) References Cited

U.S. PATENT DOCUMENTS

| | | | | |
|---|---|---|---|---|
| 5,356,010 | A | 10/1994 | Weinstein | |
| 5,431,283 | A | 7/1995 | Weinstein et al. | |
| 5,791,513 | A | 8/1998 | Intini | |
| 5,909,822 | A | 6/1999 | George et al. | |
| 6,098,835 | A * | 8/2000 | DeJonge | 221/25 |
| 6,155,454 | A | 12/2000 | George et al. | |
| 6,364,155 | B1 * | 4/2002 | Wolfe | 221/25 |
| 2003/0029880 | A1 * | 2/2003 | Hunts | 221/25 |

FOREIGN PATENT DOCUMENTS

| | | |
|---|---|---|
| EP | 0129985 A1 | 1/1985 |
| EP | 0 305 895 A1 | 3/1989 |

* cited by examiner

*Primary Examiner*—David H. Bollinger
(74) *Attorney, Agent, or Firm*—Morgan, Lewis & Bockius LLP

(57) ABSTRACT

The present invention relates to a blister pack device for storing and dispensing a dosage unit, including a container having an opening for receiving a blister pack. The container is provided with a dispensing mechanism for ejecting a dosage unit from a blister or the blister pack, the dispensing mechanism includes a lever arm pivotally mounted on the container and a cavity in the container for receiving an ejected dosage unit wherein the lever arm has a first open position allowing the blister pack to be positioned under the arm and a second lowered position for ejecting the dosage unit from the blister into the cavity.

14 Claims, 3 Drawing Sheets

BLISTER PACK DEVICE

RELATED APPLICATIONS

This application is a national stage filing under 35 U.S.C. 371 of International Application PCT/SE03/00308, filed Feb. 24, 2003, which claims priority from Sweedish Application No. 0200561-9, filed Feb. 25, 2002, the specification of each of which is incorporated by reference herein. International Application PCT/SE03/00308 was published under PCT Article 21(2) in English.

TECHNICAL FIELD OF THE INVENTION

The present invention relates to a blister pack device for storing, protecting and dispensing a dosage unit, i.e. a tablet or capsule from a blister pack.

BACKGROUND OF THE INVENTION

Blister packs for drugs in tablet form or in the form of powder or liquid enclosed in a capsule normally incorporate at least one blister part, which consists of a set of interconnected foils covering each other. One relatively rigid foil is in most cases referred to as the base and comprises cavities, so-called open "blisters", for accommodating a tablet or a capsule each, while the other foil, which is flat, is in most cases referred to as the lid and seals the opening of the cavities or blisters.

Blister packs can be accidentally damaged during transport or by being carried around in pockets, handbags etc. Such damage occurs frequently, especially if the lid foil is breakable. To avoid the accidental damage blister packs are normally stacked in a separate box or casing, which protects the blisters during transport and storage.

For dispensing a tablet or capsule from a blister, the user is required to push the pill or tablet through the rupturable lid foil. Some blister packs have a design that makes them difficult to open and others are intentionally more difficult to open in order to prevent or discourage small children from easily pushing pills out of the blister packs. These packs sometimes become very difficult for the average person to open. Further, also blister packs that are relatively easy for the average adult to open, can be difficult to open for handicapped, elderly people and people with arthritis and other hand impediments.

U.S. Pat. No. 5,791,513 relates to a pill-dispensing device for use in dispensing a capsule from a blister pack. The device comprises first and second members hinged to each other. A blister pack is introduced between the two members and a pusher element projecting from the first member pushes the capsule out from the blister when the first and second elements are closed. A device like this can be sold separately for use together with a blister pack. A drawback with this kind of device is that it is bulky and therefore not always suitable for the user to bring with him/her. Further, it does not protect the blister pack.

U.S. Pat. No. 5,356,010 discloses a container with a blister pack opener, which container is designed to receive a blister pack and is provided with a blister pack opener for puncturing the back foil of the blister pack to get access to the content of the blister. The blister pack opener is hinged to the container and has a toothed member for puncturing the back foil of the blister pack. When the back foil is punctured the dosage unit can be removed by a user pushing the dosage unit through the punctured backing foil. A major disadvantage of this device is that even if the blister is opened as the back foil is punctured the user still has to push out the content from the blister by using one or both hands.

SUMMARY OF THE INVENTION

An object of the present invention is to provide a blister pack device that overcomes or alleviates the drawbacks of the known devices and which provides a blister pack device for effective and accurate storage and dispensing of a dosage unit from a blister pack. In this way, the blister pack will be protected during transport in a handbag, a pocket or the like and at the same time the user will easily get access to the content of the blister pack.

A further object of the present invention is to provide a blister pack device that is simple to use especially for users having some kind of hand impediment.

Another object of the present invention is to provide a blister pack device having a dispensing means supplying enough force to eject a dosage unit from a blister pack having a tough back foil, i.e. a child resistant blister pack.

Still a further object of the present invention is to provide a blister pack device that can be operated by using only one hand.

The present invention provides a blister pack device for storing and dispensing a dosage unit comprising a container having an opening for receiving a blister pack. The container is provided with a dispensing means for ejecting a dosage unit from a blister of the blister pack, the dispensing means comprises a lever arm pivotally mounted on the container and a cavity in the container for receiving an ejected dosage unit wherein the lever arm has a first open position allowing the blister pack to be positioned under the lever arm and a second lowered position for ejecting the dosage unit from the blister into the cavity.

Preferably, the dispensing means further comprises a guide plate for positioning the blister pack under the lever arm and over the cavity.

Preferably, the guide plate is positioned on the container adjacent the cavity and is further provided with a U-shaped indentation partly surrounding the cavity for positioning a blister of the blister pack.

For receiving the blister pack in the right position a gap is preferably provided between the container and the guide plate.

Preferably, the guide plate comprises at least one leg partly surrounding the cavity and fixing a blister in the guide plate.

For pushing the content out of the blister, the lever arm is preferably provided with a protruding member.

Preferably, the lever arm is connected to the container via a hinge.

Preferably, the lever arm is L-shaped such that the distal end of the lever arm closes off the opening of the container in a closed position.

Preferably, the distance (b) between the protruding member and the distal end of the lever arm is greater than the distance (a) between the protruding member and the hinge.

Preferably, the relationship b/a between the distances a and b has a value between 1.5 and 5.

Preferably, the container is provided with a notch on each side of the opening for easy access of the blister pack.

Preferably, the container and the lever arm are made out of a plastics material.

Preferably, the container is at least partially transparent.

Preferably, the lever arm is at least partially transparent.

The main advantage of the present invention is that it provides effective protection for the blister pack and at the same time an effective dispensing means for ejecting a dosage unit.

A further advantage of the present invention is that in can be operated using only one hand.

Still a further advantage of the present invention is that the lever arm provides enough force such that even users with weak hands can eject a dosage unit from a blister pack having a tough back foil, such as a child resistant blister pack.

BRIEF DESCRIPTION OF THE DRAWINGS

The above and other features and advantages of the invention are defined in the claims and described in greater detail below with reference to the accompanying drawings, which illustrate preferred embodiments.

FIG. 3 shows a perspective view of the blister pack device with a blister pack positioned for dispensing a dosage unit there from.

DESCRIPTION OF PREFERRED EMBODIMENTS

Figure 1:
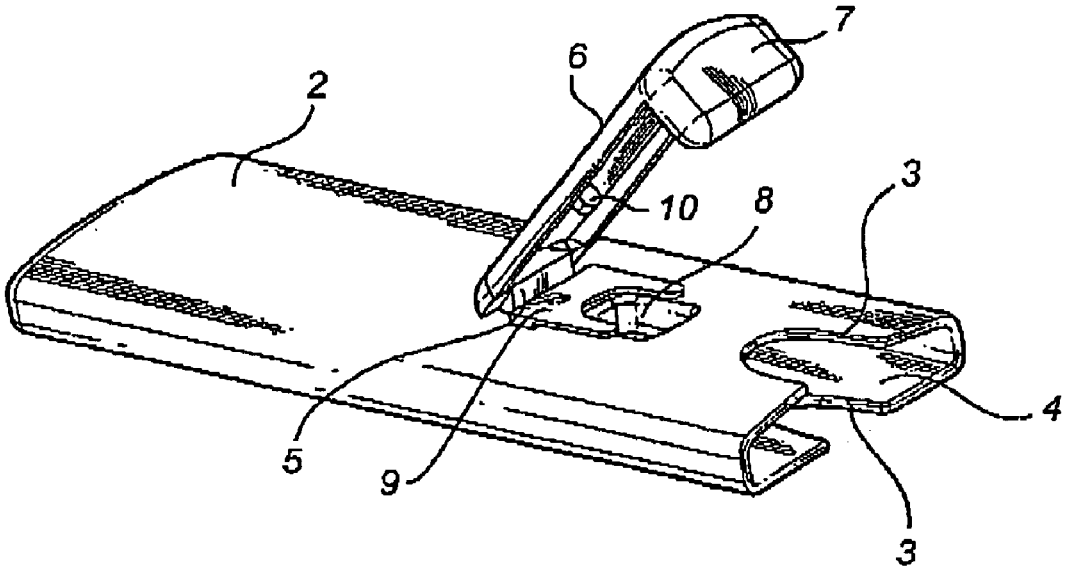
FIG. 1 illustrates a perspective view of the blister pack device in an open position.

FIG. 1 illustrates a blister pack device 1, which comprises a container 2 having an opening 4 for receiving a blister pack and a dispensing means for ejecting a dosage unit from a blister of the blister pack. A dosage unit is for example a tablet or a capsule. A notch 3 is provided in the container material on each side of the opening 4 to facilitate the withdrawal of the blister pack 12 from the container. Inside the container there is also space for receiving a leaflet carrying information to the user, such as patient information. In a preferred embodiment, the container 2 is substantially flat and elongate formed of a plastics material, such as polypropylene or polycarbonate.

The dispensing means can be seen in FIG. 1 showing the blister pack device in an open position. The dispensing means comprises a lever arm 6, a guide plate 9 for positioning the blister pack and a cavity 8 receiving the ejected dosage unit. The lever arm is attached to the container 2 via a hinge 5 such that the lever arm is movable between an open position allowing a blister pack to be positioned under the lever arm and a lowered position for ejecting a dosage unit from the blister pack into the cavity. The cavity 8 is a depression in the material of container 2, the cavity being positioned under the lever arm 6 between the opening 4 and the hinge 5.

Figure 2:
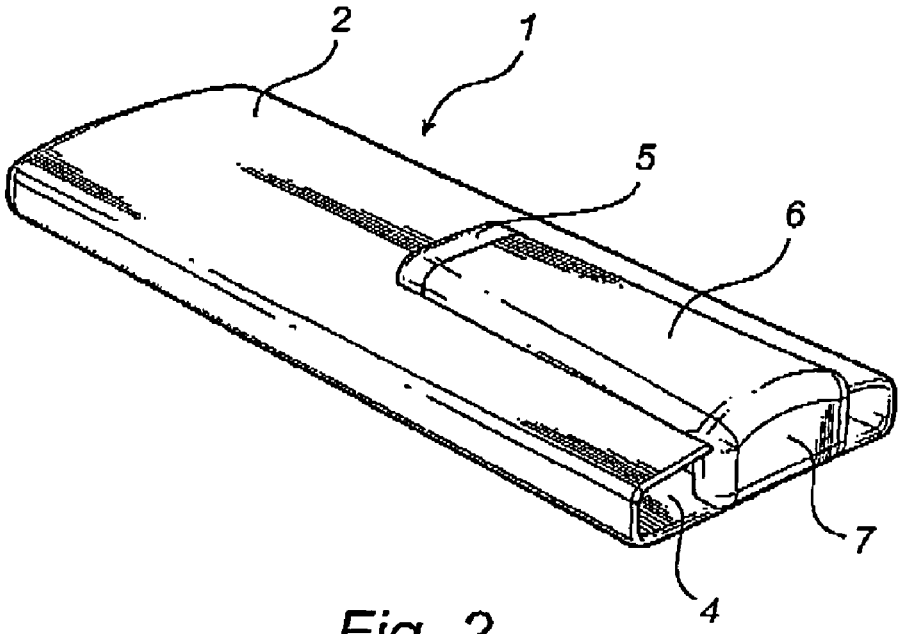
FIG. 2 illustrates a perspective view of the blister pack device in a closed position.

FIG. 2 shows the blister pack device 1 in a closed position for storing and protecting a blister pack inside the container 2. The lever arm 6 being a part of the dispensing means also has the function of being a closing member for closing off the opening 4. The lever arm has a L-shaped form and the distal end 7 of the lever arm closes off the opening 4. A thin rim (not shown) under the edge of the distal end 7 of the lever arm will snap fit onto the end of the container when the lever arm closes the opening 4.

In a preferred embodiment the container 2 is made partially transparent such that the user can see the blister pack 12 and the number of doses left in it inside the container. Also the lever arm 6 can be made at least partially transparent as to facilitate the positioning of the blister pack into the guide plate 9 under the lever arm.

Figure 3:
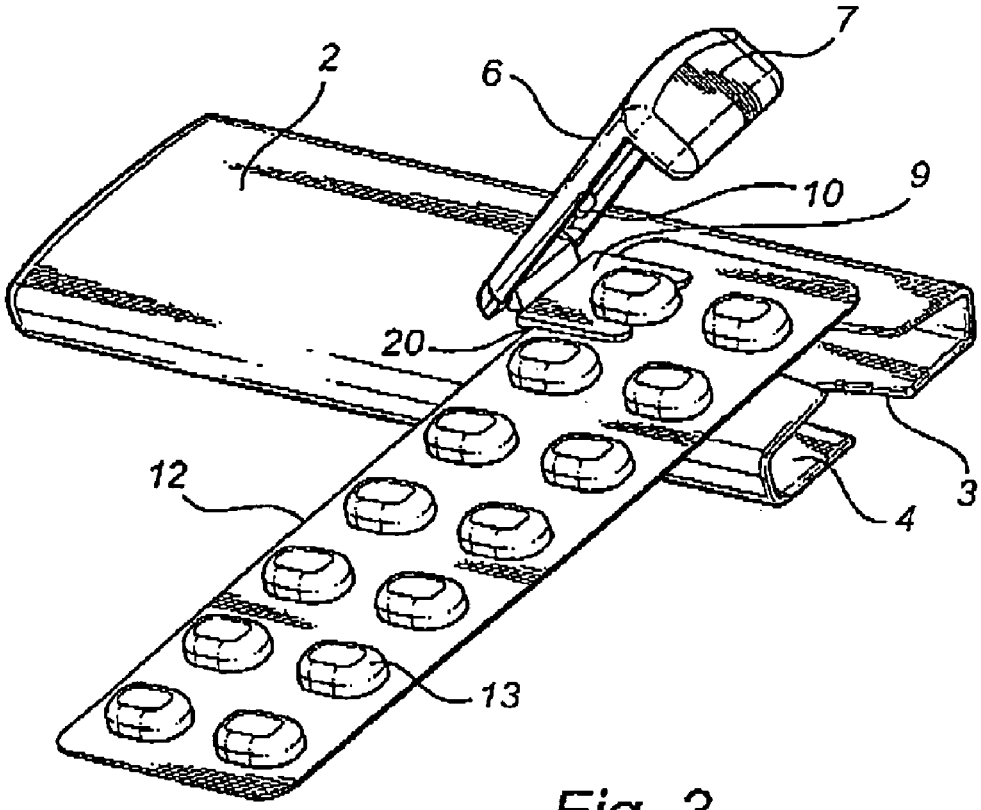
Figure 5A:
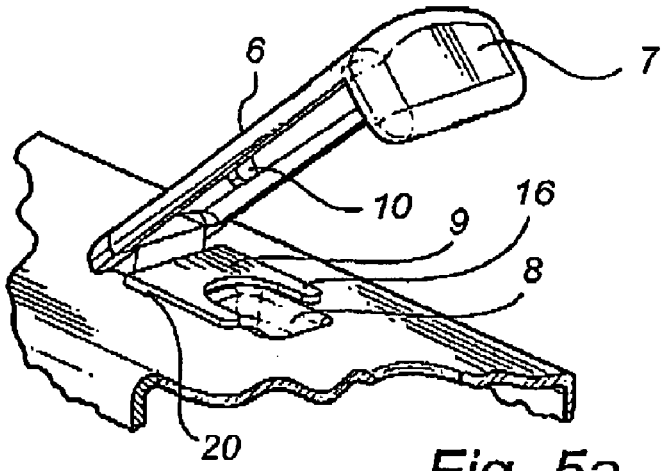
FIGS. 5*a*–5*c* illustrates in enlarged scale the dispensing means of the blister pack device of FIG. 1.
Figure 5B:
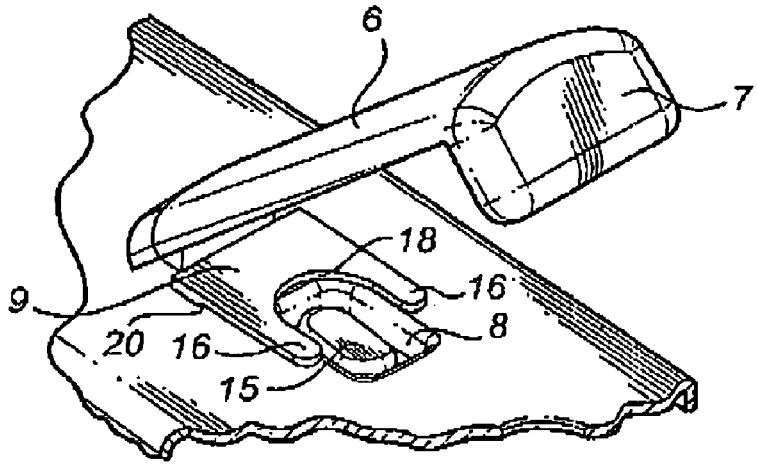

In FIG. 3, a blister pack 12 is introduced into position under the guide plate 9 for ejecting a dosage unit from a blister 13. The blister pack is introduced in a gap 20 between the container 2 and the guide plate 9. The width of the gap 20 is dimensioned to receive a blister pack. The guide plate further has a U-shaped indentation 18 partly surrounding the cavity 8 and two legs 16 on each side of the cavity for positioning and fixing the blister 13 in a correct position. Details of the dispensing means can be seen in FIGS. 5*a* to 5*c*. A protrusion 10 is provided on the inside of the lever arm 6 for pushing the dosage unit 15 from the blister into the cavity. As the lever arm is lowered the protrusion 10 pushes out the content of the blister 13 into the cavity 8 located under the guide plate and lever arm. The blister pack 12 is then removed, preferably put back into the container 2 and the user can pick up or tip out the dosage unit 15 from the cavity.

Figure 4:
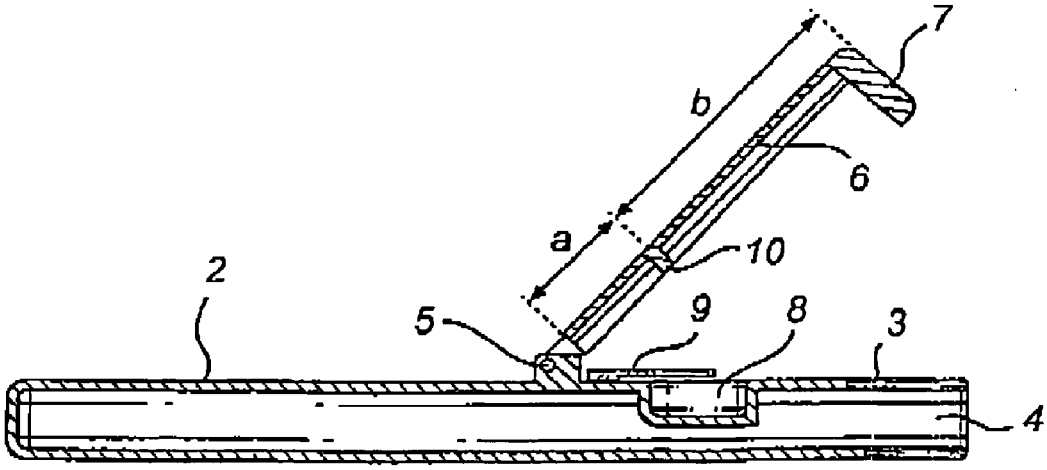
FIG. 4 is a cross-section of the blister pack device according to FIG. 1.

The lever action will provide enough force for ejecting a tablet from a blister pack having a tough back foil, i.e. a child resistant blister pack. The tough, strong film is used to prevent children from getting access the content of the blisters. Unfortunately, this film is sometimes so strong that an adult user with weak hands or a hand impediment cannot eject the content. Therefore, the present invention discloses a device that is able to develop enough force in the dispensing means to open such blisters. To be able to develop enough force from the lever arm the relationship b/a between the distances a and b should be 1.5 to 5. The distances a and b are shown in FIG. 4 where a is the distance between the protruding member 10 and the hinge 5 and b is distance between the protruding member 10 and the distal end 7 of the lever arm. By use of the lever arm for dispensing the content from a blister the user needs less hand force than if he/she had to push out the content from the blister with their fingers. In this way even persons with reduced hand strength will be able to dispense the content from a blister pack.

Figure 5C:
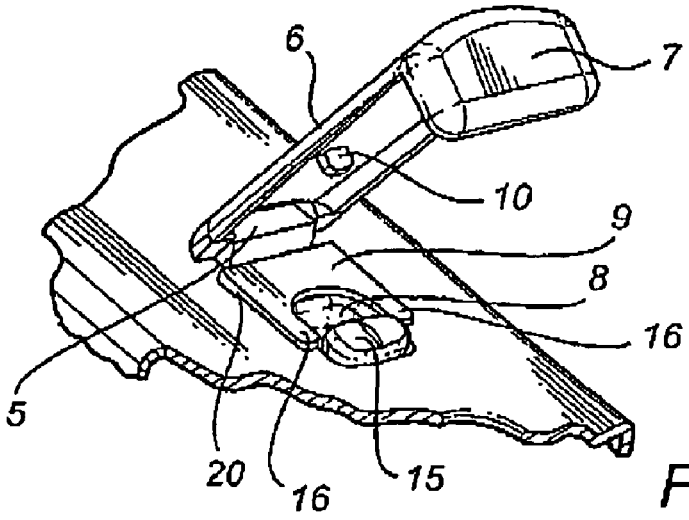

The lever arm may also be used to divide already ejected dosage units, i.e. tablets. In FIG. 5*c* an elongate tablet 15 is positioned on the edge of the cavity to be divided by the protrusion 10 of the lever arm. Further, the cavity 8 can be used to store an already ejected dosage unit or half a tablet for later use.

Further, it will be understood that the present invention is not limited to the described embodiments but can be modified in many different ways without departing from the scope of the appended claims.

The invention claimed is:

1. A blister pack device for storing a blister pack and dispensing a dosage unit there from, comprising a container having an opening for receiving the blister pack wherein the container is provided with a dispensing means for ejecting a dosage unit from a blister of the blister pack, the dispensing means comprises a lever arm pivotally mounted on the container and a cavity in the container for receiving an ejected dosage unit wherein the lever arm has a first open position allowing the blister pack to be positioned on the outside of the container under the lever arm and a second lowered position for ejecting the dosage unit from the blister into the cavity.

2. A blister pack device according to claim 1, wherein the dispensing means further comprises a guide plate for positioning the blister pack between the lever arm and the cavity.

3. A blister pack device according to claim 2, wherein the guide plate is positioned on the container adjacent the cavity.

4. A blister pack device according to claim 2 or 3, wherein a gap is provided between the container and the guide plate for receiving the blister pack.

5. A blister pack device according to claim 2 or 3, wherein the guide plate is provided with a U-shaped indentation partly surrounding the cavity for positioning a blister of the blister pack.

6. A blister pack device according to claim 2 or 3, wherein the guide plate comprises at least one leg partly surrounding the cavity and fixing a blister in the guide plate.

7. A blister pack device according to claim 1, wherein the lever arm is provided with a protruding member for pushing a dosage unit out of the blister into the cavity.

8. A blister pack device according to claim 7, wherein the lever arm is connected to the container via a hinge, and a distance (b) between the protruding member and a distal end of the lever arm is greater than a distance (a) between the protruding member and the hinge.

9. A blister pack device according to claim 8, wherein a relationship b/a between the distances (a) and (b) has a value between 1.5 and 5.

10. A blister pack device according to claim 1, wherein the lever arm is L-shaped such that a distal end of the lever arm closes off the opening of the container in a closed position.

11. A blister pack device according to claim 1, wherein the container is provided with a notch on each side of the opening of the container.

12. A blister pack device according to claim 1, wherein the container and the dispensing means are made out of a plastics material.

13. A blister pack device according to claim 1, wherein the container is partially transparent.

14. A blister pack device according to claim 1, wherein the lever arm is at least partially transparent.

* * * * *